US005381661A

United States Patent [19]

Malina

[11] Patent Number: 5,381,661

[45] Date of Patent: Jan. 17, 1995

[54] HYDRAULIC PRESSURE TRANSFORMER

[75] Inventor: Viktor Malina, Kisslegg, Germany

[73] Assignee: TOX-Pressotechnik GmbH, Weingarten, Germany

[21] Appl. No.: 84,976

[22] Filed: Jul. 2, 1993

[30] Foreign Application Priority Data

Jul. 2, 1992 [DE] Germany ..... 4221638

[51] Int. Cl.[6] ..... F15B 7/00

[52] U.S. Cl. ..... 60/560; 60/563; 60/565; 60/593

[58] Field of Search ..... 91/4; 60/540.1, 547.2, 60/560, 563, 565, 583, 593

[56] References Cited

U.S. PATENT DOCUMENTS 2,827,766 3/1958 Hufford ..... 60/560
2,915,878 12/1959 Hramoff ..... 60/593
3,200,596 8/1965 Olson et al. ..... 60/560
4,300,351 11/1981 Grüllmeier ..... 60/560
4,509,330 4/1985 Zimber et al. ..... 60/547.1
5,125,234 6/1992 Yonezawa et al. ..... 60/563

*Primary Examiner*—Thomas E. Denion
*Attorney, Agent, or Firm*—Edwin E. Greigg; Ronald E. Greigg

[57] ABSTRACT

The invention relates to a hydraulic pressure transformer, wherein a storage chamber and a work chamber are connected with each other via an overflow bore into which a plunger piston dips to generate a pressure stage and thereby separates the two chambers for generating a high pressure in the work chamber. An additional connecting conduit with a check valve is provided between the work chamber and the storage chamber.

20 Claims, 1 Drawing Sheet

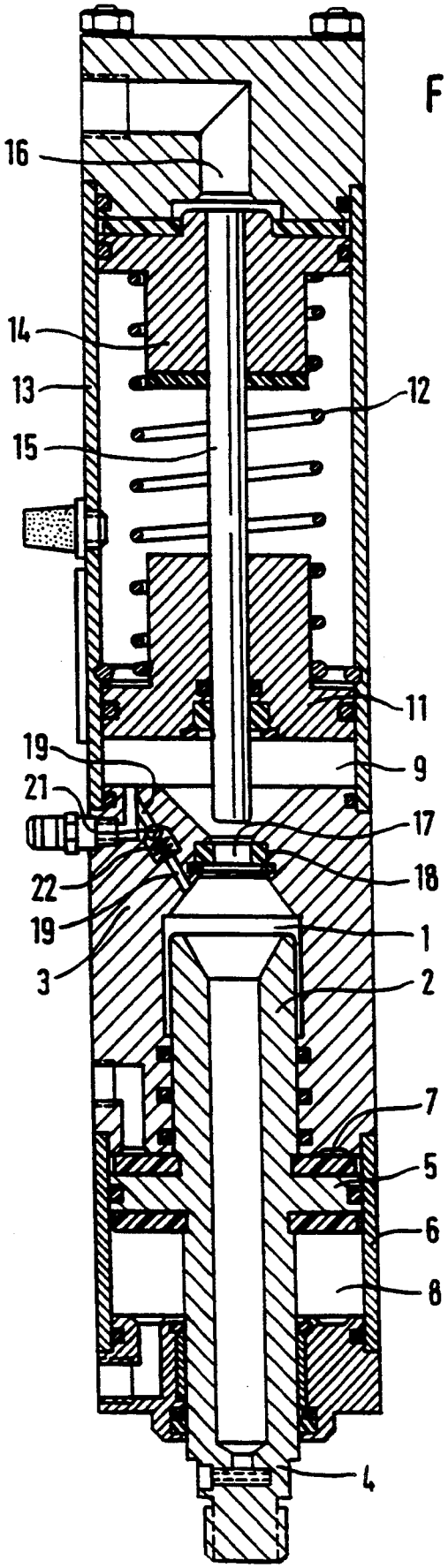
Fig. 1
Fig. 2
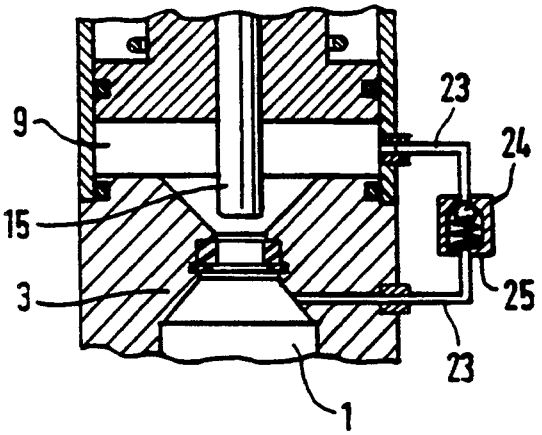

HYDRAULIC PRESSURE TRANSFORMER

FIELD OF THE INVENTION

The invention relates to a hydraulic pressure transformer as defined hereinafter.

BACKGROUND OF THE INVENTION

In known hydraulic pressure transformer of the type of the species (German Letters Patent 28 18 332), the plunger piston is maintained in its initial position by means of a restoring spring, and this spring simultaneously acts on a storage piston, by which the low pressure is generated in the storage chamber. As soon as the working piston has been released for a rapid stroke—operated pneumatically in this known hydraulic pressure transformer—, the hydraulic fluid flows from the storage chamber under this low pressure into the work chamber which is being enlarged. As soon as the plunger piston is operated and especially when it dips into the bore in a radially sealing manner, the high pressure which causes the further operation of the work piston is generated in the work chamber during the continued displacement of the plunger piston into the hydraulic fluid therein. In actual operation it was noted that there is an extraordinary sensitivity of the control at this separation point which, on the one hand is affected by the pressure differences in the course of the always present compressibility of the hydraulic fluid and, on the other, by the working speed which is primarily affected by the mass inertia of the individual parts. The radial seal in the bore also has a certain effect on the control quality.

Extensive research in connection with manufacturing errors which occurred in such hydraulic pressure transformers led to assumptions regarding the above mentioned control problems and to improvements in the individual parts affecting the control and partially recited above, and in the controls of the hydraulic pressure transformers, without achieving an actual correction of the disadvantages. Since, among others, clinch connections and rivet connections are produced with such hydraulic pressure transformers, the varying and even lacking precision has an effect on the quality of the connection. These defects can hardly be recognized by the unaided eye and can only be found with the most modern measuring devices.

In contrast thereto, the hydraulic pressure transformer has the advantage that extreme precision in the repetition of the individual operating steps is attained, and this with a comparatively low effort. If the plunger piston dips too soon into the bore and the high-pressure seal located there and fluid can no longer flow via this conduit from the storage chamber to the work chamber, in accordance with the invention hydraulic fluid flows from the storage chamber into the work chamber via the second connecting conduit. In this way the creation of a partial vacuum in the work chamber is prevented, which could lead to the liberation of air combined with the hydraulic fluid and even to foaming of the oil. Then, if the plunger piston follows the advancing work piston, the work chamber is filled by means of the hydraulic fluid which in the meantime flowed through the connecting conduit, so that in this case the power stroke starts exactly at the same time as the displacement of the plunger piston. A similar advantage then also occurs during the reverse stroke of the plunger piston if it leads the work piston, so that a partial vacuum can be created in the work chamber, because hydraulic fluid can simultaneously flow through the connecting conduit of the invention from the storage chamber into the work chamber prior to the time this hydraulic fluid can flow back into the storage chamber via the bore during the reverse stroke of the work piston.

In connection with a further very essential advantage of the invention, which manifests itself in the manner of an inventive process, the power stroke of the work piston can take place in several stages. Between these stages, the plunger piston can move back by a required stroke and hydraulic fluid can flow from the storage chamber into the work chamber during this reverse stroke. In this case the course of the operation or the course of the process consists of the following steps:

pneumatic rapid stroke of the work piston, with simultaneous flow of hydraulic fluid from the storage chamber into the work chamber via the bore as well as the connecting conduit, power stroke of the work piston after actuation of the plunger piston and its entry into the bore, termination of this first power stroke by ending of the forward stroke of the plunger piston, second pneumatic rapid stroke of the work piston with simultaneous slight reverse stroke of the plunger piston and flow of hydraulic fluid via the connecting conduit of the invention into the work chamber, filling it in the process, forward stroke of the plunger piston into the work chamber with simultaneous drive of the work chamber for its second power stroke.

The reverse stroke of the work piston then takes place as described in detail. It is also possible, if required, to perform additional power strokes instead of two power strokes, and different control sequences are also possible. Thus, for example, instead of a second rapid stroke the work piston can pause in the work position after the first power stroke, during which time the plunger piston moves back. Then, regarding the stroke, the second power stroke begins immediately after the first power stroke of the work piston. With this process it is decisive that the plunger piston move back a little during an interim period of time, while hydraulic fluid can flow from the storage chamber into the work chamber. In this way it is possible to divide the stroke of the plunger piston, which is mainly required during a plurality of stages, into a plurality of sections with appropriate reverse strokes, so that the cross sectional ratio between plunger piston and work piston can be chosen in extremely different ways, which results in the advantage of extraordinarily high pressure transformation.

In accordance with an embodiment of the invention, a check valve opening in the direction of the work chamber and closing in the direction of the storage chamber is disposed in the connecting conduit. This check valve can be embodied with or without a closure spring and it can be disposed as a sliding valve, a ball valve or other check valve, such as a flutter valve, for example. Decisive for the opening of the check valve is the difference between the pressures in the work chamber and the storage chamber and, of course, the surface of the movable valve part being acted upon, as well as the force of the closure spring. In this connection the closure spring can be embodied such that a small pressure already suffices for its opening.

In accordance with a further advantageous embodiment of the invention, the connecting conduit and the check valve are disposed in the housing of the hydraulic pressure transformer.

In accordance with yet another advantageous embodiment of the invention, the two chambers are connected with each other outside of the housing via a line, in which the check valve is disposed.

The employment of the invention in a hydraulic pressure transformer in the form of a hydro-pneumatic pressure transformer having the characteristics as disclosed herein is particularly advantageous. A hydro-pneumatic pressure transformer of this type is known per se (German Letters Patent 28 18 337) and its main problem lies in that, because of the additional independent pneumatic operation of the work piston, the latter leads the plunger piston or lags behind during the reverse stroke.

The invention is of course also applicable to such hydro-pneumatic pressure transformers where both the storage chamber and the work chamber are respectively housed in by and large independent cylinders, but which are particularly disposed in parallel, as are known per se and have been produced for some time. Regardless of whatever type, it is decisive that this additional connecting conduit is provided between the storage chamber and the work chamber.

Further advantages and advantageous embodiments of the invention can be found in the subsequent description of the drawings and the claims.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 is a longitudinal section through a hydro-pneumatic pressure transformer, and FIG. 2 is a detail of FIG. 1 with a variant of the invention.

DETAILED DESCRIPTION OF THE PREFERRED EMBODIMENT

In the exemplary embodiment shown in FIG. 1, a work piston 2 is disposed axially displaceable in a work chamber 1 filled with hydraulic oil when in operation and is guided in a bore of a housing 3. A piston rod 4 extending to the outside of the housing is disposed on the work piston 2 for the transfer of a force onto oil in the work chamber. In addition, a ring piston 5 is integral with the work piston 2 and the piston rod 4. This ring piston 5 is radially sealed with respect to a casing 6 and thus separates two chambers 7 and 8, which are alternately provided with compressed air for the rapid stroke of the work piston 2. As soon as overpressure has been generated in the pneumatic chamber 7, the work piston 2 is pushed down. As soon as overpressure is generated in the pneumatic chamber 8, the work piston 2 is again upwardly displaced into the initial position shown.

As shown in the drawings, a storage chamber 9 is provided above the work chamber 1 and is hydraulically connected with the work chamber. By means of a storage piston 11 with a storage spring 12, a low hydraulic storage pressure is generated in storage chamber 9 which is sufficient to keep the work chamber 1 filled with hydraulic oil from the storage chamber 9 during the rapid stroke of the work piston 2. The storage piston 11 is guided in a casing 13 in a radially sealing and axially displaceable manner. A drive piston 14 of a plunger piston 15 is also guided in a radially sealing and axially displaceable manner in this casing 13 and is displaceable in the direction toward the work chamber 1 against the force of the storage spring 12. The plunger piston 15 extends through the storage piston 11 in a radially sealed manner and extends into the storage chamber 9. The drive piston 14 with the plunger piston 15 is driven by compressed air which is fed into a control chamber 16 above the drive piston 14. This supply of compressed air takes place after the work piston 2 has finished its rapid stroke and before the actual pressure stroke of the work piston 2 is intended to start. When the drive piston 14 is displaced by means of the compressed air, the plunger piston 15, after having performed a pre-stroke, extends into a connecting bore 17 leading from the storage chamber 9 to the work chamber 1. Because of this, this flow connection is interrupted with the cooperation of a radial seal 18 so that, with the plunger piston 15 continuing to extend into the work chamber, hydraulic fluid is displaced there and correspondingly acts on the work piston 2. Because the cross-sectional surface of the drive piston 14 is considerably greater than that of the plunger piston 15, there is a correspondingly high pressure transformation of pneumatic pressure in the control chamber 16 to hydraulic pressure in the work chamber 1. Since, in turn, the cross-sectional surface of the work piston 2 is considerably greater than that of the plunger piston 15, a further force transformation within the work chamber 1 in the direction toward the work piston 2 is the result and thus a corresponding displacement force is transmitted at the piston rod 4.

For the return stroke of the piston rod 4, the pneumatic pressure in the control chamber 16 is relieved so that the storage spring 12 pushes the drive piston 14 back into the indicated initial position. Simultaneously the work piston 2 is pushed into the indicated initial position by the ring piston 5 because of pressure release in the pneumatic chamber 7 or pressure increase in the pneumatic chamber 8. In the course of this, hydraulic fluid is pushed back into the storage chamber 9 by the work piston 2 and the storage piston 11 is pushed back into the indicated initial position against the force of the storage spring 12.

In accordance with the invention, a connecting conduit 19 is provided in the housing 3 in addition to the connection bore 17 between the work chamber 1 and the storage chamber 9, in which a one-way check valve is disposed, which blocks fluid flow in the direction of the storage chamber 9 and has a movable valve member 21 and a spring 22. It is possible for hydraulic fluid to flow from the storage chamber 9 into the work chamber 1 even when the connecting bore 17 is blocked by the plunger piston 15 or the radial seal 18.

In a variant of the invention illustrated in FIG. 2, a line 23 extending outside of the housing is used as the connecting circuit between the storage chamber 9 and the work chamber 1. An appropriately disposed one-way check valve with a movable valve member 24 and a spring 25 is placed in the line 23, this check valve 24, 25 also blocks fluid flow in the direction of the storage chamber 9 from the work chamber 1.

The foregoing relates to preferred exemplary embodiments of the invention, it being understood that other variants and embodiments thereof are possible within the spirit and scope of the invention, the latter being defined by the appended claims.

What is claimed and desired to be protected by letter patent of the United States is:

1. A hydraulic pressure transformer including a housing (3), a work chamber (1) in said housing, which is filled with a hydraulic fluid during operation, a work piston (2) operates in said housing in conjunction with said work chamber, a piston rod (4) is connected with said work piston and extends outside of the housing (3), a storage chamber (9) which is filled with a hydraulic fluid during operation, a bore (17) of a defined cross section provides a connection which hydraulically connects said storage chamber (9) with said work chamber (1), a casing (13) which is secured to said housing (3), a drive piston (14) operable in said casing, a plunger piston (15) secured to said drive piston, said plunger piston (15) is of a smaller diameter than that of the work piston (2), said plunger piston is forced under low pressure in a radially sealing manner into the bore (17), while a flow of hydraulic fluid out of the storage chamber (9) into the work chamber (1) takes place, and said plunger piston returns out of the bore (17), generating a corresponding high pressure, so that the hydraulic fluid can flow from the work chamber (1) back into the storage chamber, a connecting conduit (19, 23) is disposed between the work chamber (1) and storage chamber (9) in addition to the connection containing the bore (17), said connecting conduit is blocked against fluid flow back to said storage chamber when high pressure begins in said work chamber and is opened at low pressure in a direction of fluid flow towards the work chamber (1).

2. A hydraulic pressure transformer in accordance with claim 1, in which a one-way check valve (21, 22, 24, 25) is disposed in the connecting conduit (19, 23), which opens in a direction toward the work chamber (1) and closes in a direction toward the storage chamber (9).

3. A hydraulic pressure transformer in accordance with claim 2, in which a movable valve member (21, 24) of the check valve is loaded by means of a spring (22, 25).

4. A hydraulic pressure transformer in accordance with claim 1, in which the connecting conduit (19) extends inside the housing (3).

5. A hydraulic pressure transformer in accordance with claim 2, in which the connecting conduit (19) extends inside the housing (3).

6. A hydraulic pressure transformer in accordance with claim 3, in which the connecting conduit (19) extends inside the housing (3).

7. A hydraulic pressure transformer in accordance with claim 1, in which the connecting conduit is formed by a line (23) extending outside of the housing and between said work chamber (1) and said storage chamber (9).

8. A hydraulic pressure transformer in accordance with claim 2, in which the connecting conduit is formed by a line (23) extending outside of the housing and between said work chamber (1) and said storage chamber (9).

9. A hydraulic pressure transformer in accordance with claim 3, in which the connecting conduit is formed by a line (23) extending outside of the housing and between said work chamber (1) and said storage chamber (9).

10. A hydraulic pressure transformer in accordance with claim 4, in which the connecting conduit is formed by a line (23) extending outside of the housing and between said work chamber (1) and said storage chamber (9).

11. A hydraulic pressure transformer in accordance with claim 5, in which the connecting conduit is formed by a line (23) extending outside of the housing and between said work chamber (1) and said storage chamber (9).

12. A hydraulic pressure transformer in accordance with claim 6, in which the connecting conduit is formed by a line (23) extending outside of the housing and between said work chamber (1) and said storage chamber (9).

13. A hydraulic pressure transformer in accordance with claim 1, in which said work piston (2), said work chamber (1), said bore (17), said storage chamber (9) and said plunger piston (15) are disposed on a same axis, means for actuation of the drive piston (14) and the plunger piston (15) counter to a restoring force (12), said bore (17) is in a transverse wall between the work chamber (1) and the storage chamber (9) and a lip seal (18) suitable for high pressure is disposed in the bore (17), a storage piston (11), which provides a storage pressure, is operatively loaded for axial displacement and includes radially sealing, said storage piston separates the storage chamber (9) from a chamber filled with air; and an auxiliary piston (5) is formed by a ring piston integral with the work piston (2), said auxiliary piston (5) can be charged with pressure alternately on either side for producing rapid strokes of said work piston.

14. A hydraulic pressure transformer in accordance with claim 2, in which said work piston (2), said work chamber (1), said bore (17), said storage chamber (9) and said plunger piston (15) are disposed on a same axis, means for actuation of the drive piston (14) and the plunger piston (15) counter to a restoring force (12), said bore (17) is in a transverse wall between the work chamber (1) and the storage chamber (9) and a lip seal (18) suitable for high pressure is disposed in the bore (17), a storage piston (11), which provides a storage pressure, is operatively loaded for axial displacement and includes radially sealing, said storage piston separates the storage chamber (9) from a chamber filled with air; and an auxiliary piston (5) is formed by a ring piston integral with the work piston (2), said auxiliary piston (5) can be charged with pressure alternately on either side for producing rapid strokes of said work piston.

15. A hydraulic pressure transformer in accordance with claim 3, in which said work piston (2), said work chamber (1), said bore (17), said storage chamber (9) and said plunger piston (15) are disposed on a same axis, means for actuation of the drive piston (14) and the plunger piston (15) counter to a restoring force (12), said bore (17) is in a transverse wall between the work chamber (3) and the storage chamber (9) and a lip seal (18) suitable for high pressure is disposed in the bore (17), a storage piston (11), which provides a storage pressure, is operatively loaded for axial displacement and includes radially sealing, said storage piston separates the storage chamber (9) from a chamber filled with air; and an auxiliary piston (5) is formed by a ring piston integral with the work piston (2), said auxiliary piston (5) can be charged with pressure alternately on either side for producing rapid strokes of said work piston.

16. A hydraulic pressure transformer in accordance with claim 4, in which said work piston (2), said work chamber (1), said bore (17), said storage chamber (9) and said plunger piston (15) are disposed on a same axis, means for actuation of the drive piston (14) and the plunger piston (15) counter to a restoring force (12), said bore (17) is in a transverse wall between the work chamber (1) and the storage chamber (9) and a lip seal (18) suitable for high pressure is disposed in the bore (17), a storage piston (11), which provides a storage pressure, is operatively loaded for axial displacement and includes radially sealing, said storage piston separates the storage chamber (9) from a chamber filled with air; and an auxiliary piston (5) is formed by a ring piston integral with the work piston (2), said auxiliary piston (5) can be charged with pressure alternately on either side for producing rapid strokes of said work piston.

17. A hydraulic pressure transformer in accordance with claim 5, in which said work piston (2), said work chamber (1), said bore (17), said storage chamber (9) and said plunger piston (15) are disposed on a same axis, means for actuation of the drive piston (14) and the plunger piston (15) counter to a restoring force (12), said bore (17) is in a transverse wall between the work chamber (1) and the storage chamber (9) and a lip seal (18) suitable for high pressure is disposed in the bore (17), a storage piston (11), which provides a storage pressure, is operatively loaded for axial displacement and includes radially sealing, said storage piston separates the storage chamber (9) from a chamber filled with air; and an auxiliary piston (5) is formed by a ring piston integral with the work piston (2), said auxiliary piston (5) can be charged with pressure alternately on either side for producing rapid strokes of said work piston.

18. A hydraulic pressure transformer in accordance with claim 6, in which said work piston (2), said work chamber (1), said bore (17), said storage chamber (9) and said plunger piston (15) are disposed on a same axis, means for actuation of the drive piston (14) and the plunger piston (15) counter to a restoring force (12), said bore (17) is in a transverse wall between the work chamber (1) and the storage chamber (9) and a lip seal (18) suitable for high pressure is disposed in the bore (17), a storage piston (11), which provides a storage pressure, is operatively loaded for axial displacement and includes radially sealing, said storage piston separates the storage chamber (9) from a chamber filled with air; and an auxiliary piston (5) is formed by a ring piston integral with the work piston (2), said auxiliary piston (5) can be charged with pressure alternately on either side for producing rapid strokes of said work piston.

19. A hydraulic pressure transformer in accordance with claim 7, in which said work piston (2), said work chamber (1), said bore (17), said storage chamber (9) and said plunger piston (15) are disposed on a same axis, means for actuation of the drive piston (14) and the plunger piston (15) counter to a restoring force (12), said bore (17) is in a transverse wall between the work chamber (1) and the storage chamber (9) and a lip seal (18) suitable for high pressure is disposed in the bore (17), a storage piston (11), which provides a storage pressure, is operatively loaded for axial displacement and includes radially sealing, said storage piston separates the storage chamber (9) from a chamber filled with air; and an auxiliary piston (5) is formed by a ring piston integral with the work piston (2), said auxiliary piston (5) can be charged with pressure alternately on either side for producing rapid strokes of said work piston.

20. A hydraulic pressure transformer in accordance with claim 8, in which said work piston (2), said work chamber (1), said bore (17), said storage chamber (9) and said plunger piston (15) are disposed on a same axis, means for actuation of the drive piston (14) and the plunger piston (15) counter to a restoring force (12), said bore (17) is in a transverse wall between the work chamber (1) and the storage chamber (9) and a lip seal (18) suitable for high pressure is disposed in the bore (17), a storage piston (11), which provides a storage pressure, is operatively loaded for axial displacement and includes radially sealing, said storage piston separates the storage chamber (9) from a chamber filled with air; and an auxiliary piston (5) is formed by a ring piston integral with the work piston (2), said auxiliary piston (5) can be charged with pressure alternately on either side for producing rapid strokes of said work piston.

* * * * *